United States Patent [19]

Farris

[11] Patent Number: 4,984,324

[45] Date of Patent: Jan. 15, 1991

[54] PUSH-PULL PAINT SCRAPER TOOL

[76] Inventor: Ben J. Farris, 304 Burleson, Smithville, Tex. 78957

[21] Appl. No.: 483,825

[22] Filed: Feb. 23, 1990

Related U.S. Application Data

[63] Continuation-in-part of Ser. No. 386,111, Jul. 28, 1989, abandoned, and Ser. No. 208,584, Jun. 20, 1988, abandoned.

[51] Int. Cl.[5] ..... A47L 13/08

[52] U.S. Cl. ..... 15/236.05; 15/236.06

[58] Field of Search ..... 15/236.05, 236.06

[56] References Cited

U.S. PATENT DOCUMENTS

| | | | |
|---|---|---|---|
| 2,236,093 | 3/1941 | Friend | 15/236.06 X |
| 2,331,676 | 10/1943 | Hansen | 15/236.05 X |
| 3,250,000 | 5/1966 | Schumann | 30/171 |
| 3,363,316 | 1/1968 | Skarsten | 15/236 X |
| 3,719,993 | 3/1973 | Caprioli | 15/104.4 X |
| 3,895,439 | 7/1975 | Ehrenberg et al. | 15/236.06 X |
| 4,305,175 | 12/1981 | Burgess | 29/81 G X |
| 4,574,417 | 3/1986 | Magnasco | 30/172 X |

FOREIGN PATENT DOCUMENTS

| | | | |
|---|---|---|---|
| 112576 | 11/1944 | Sweden | 15/236.05 |

*Primary Examiner*—Chris K. Moore

*Attorney, Agent, or Firm*—Dennis T. Griggs

[57] ABSTRACT

A paint scraper has a two section handle attached to a support head. The two handle sections are offset at predetermined angles relative to a scraper blade coupling surface portion of the support head. A scraper plate having push and pull scraper blades is removably mounted onto the support head. Extending from the support head behind the push blade is an elongated, transverse heel which reinforces the push blade.

5 Claims, 1 Drawing Sheet

PUSH-PULL PAINT SCRAPER TOOL

CROSS REFERENCE TO RELATED APPLICATION

This application is a continuation-in-part of U.S. application Ser. No. 07/386,111 filed July 28, 1989,and now abandoned, and U.S. application Ser. No. 07/208,584 filed June 20, 1988, now abandoned.

FIELD OF THE INVENTION

This invention relates generally to hand held scraper tools, and in particular to scraper tools for removing paint or varnish from finished surfaces.

BACKGROUND OF THE INVENTION

Surface preparation for renewed finishing of surfaces preliminary to applying paint, varnish, shellac, lacquer, and the like frequently requires partial or total removal of the previous finish to insure quality restoration. Large areas of existing finish sometimes are removed by a solvent or sanding. Local areas of blistering, peeling, flaking or other forms of finish deterioration are commonly removed by using a hand held scraper. Elimination of the existing peeling or flaking avoids the potential problem of applying a new finish over an unbonded area that could in turn lead to premature peeling or flaking of the new finish.

Surface finishes are sometimes removed by first applying a coating of paint remover. Once softened by the paint remover, the affected area can then be scraped by a scraping tool to remove the old coating. It is desirable to scrape away the paint without scratching or cutting the underlying surface.

DESCRIPTION OF THE PRIOR ART

Manual scrapers for removing existing surface coatings are widely available in a variety of shapes, sizes and types. Such scrapers are characterized by an elongaged handle extending generally horizontally from a scraper head on which a metal scraper is mounted. The scraping element usually includes a bladed component offset from a base plate to a distal end defining an elongated scraping edge. Depending on the ultimate application, the edge may be squared, bevelled, V-shaped or serrated. Interchangeability is provided in some scrapers by a replaceable scraper element which is removably attached to a fixed head. In such tools, scraping action is obtained by pulling the cutting edge of the scraper blade across the painted surface.

Certain refinishing jobs require stripping of paint on and about door frames, window frames and other trim structures. In some instances, the removal of paint on or about such areas is difficult to accomplish by pulling scraping action because of limited access or lack of manuevering room.

Hand held scrapers of the prior art are the disclosed in the following patents:

| | | |
|---|---|---|
| 2,333,878 | 3,250,000 | 3,363,316 |
| 3,719,993 | 4,305,175 | 4,574,417 |
| 2,236,093 | 2,331,676 | 3,895,439 |
| | Swedish Patent 112,576 | |

OBJECTS OF THE INVENTION

A general object of the present invention is to provide an improved handheld scraper for removal of existing surface finishes.

A specific object of the invention is to provide an improved hand held scraper having a handle adapted for push scraping action.

A related object of the invention to provide an improved hand held scraper which is adapted for push-pull dual direction surface scraping.

SUMMARY OF THE INVENTION

An improved hand held scraper tool is provided for selective scraping by either push or pull action. The scraper tool includes an elongated handle attached to a generally squared support head. The elongated handle is formed in two handle sections which are offset at first and second predetermined angles relative to the horizontal plane of the support head. A scraper plate mounted onto the support head includes a pair of downwardly extending blades which are angularly offset at controlled angles to accommodate push or pull scraping action, respectively. A heel integrally formed with the support head provides reinforcement for the rear blade when used for push scraping.

The handle is formed in two handle sections, with the first handle section being angularly inclined with respect to the support head, and the second handle section being angularly inclined with respect to the first handle section. Because of the angularly offset handle section arrangement, a pushing force applied against the handle operates through a pressure point behind the push blade and along a line transverse to a plane containing the cutting edge of the push blade. This permits the handle to pivot about the line of engagement of the push blade cutting edge as the push blade glides across a finished surface. Turning moments are counteracted by applying pressure against the support head and handle on the opposite sides of the push blade. Accordingly, the scraping angle of attack can be controlled and the transverse component of scraping force can be limited during a push scraping operation, thereby assuring efficient scraping action while avoiding damage to the underlying surface.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
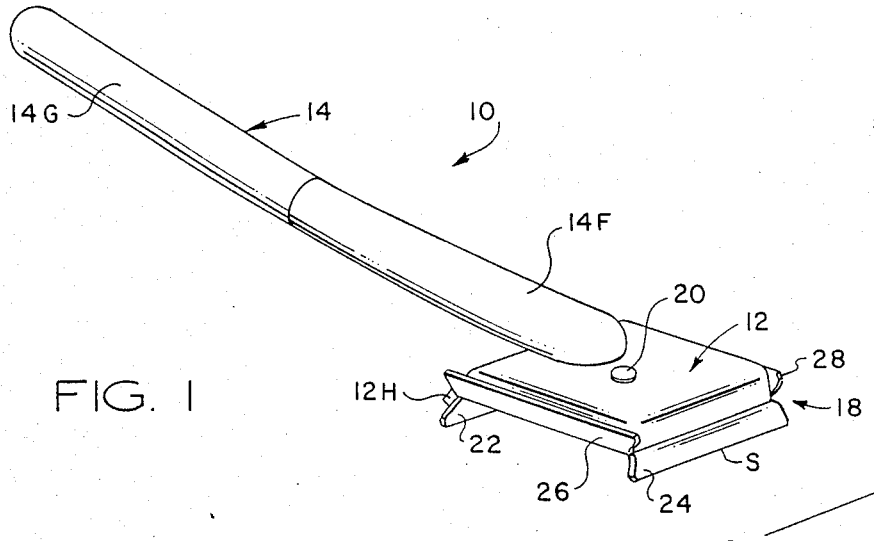
FIG. 1 is a perspective top view of the scraper tool of the invention.

In the description which follows, like parts are marked throughout the specification and drawings with the same reference numerals, respectively. The drawing figures are not necessarily to scale and the proportions of certain parts have been exaggerated for purposes of clarity.

Figure 2:
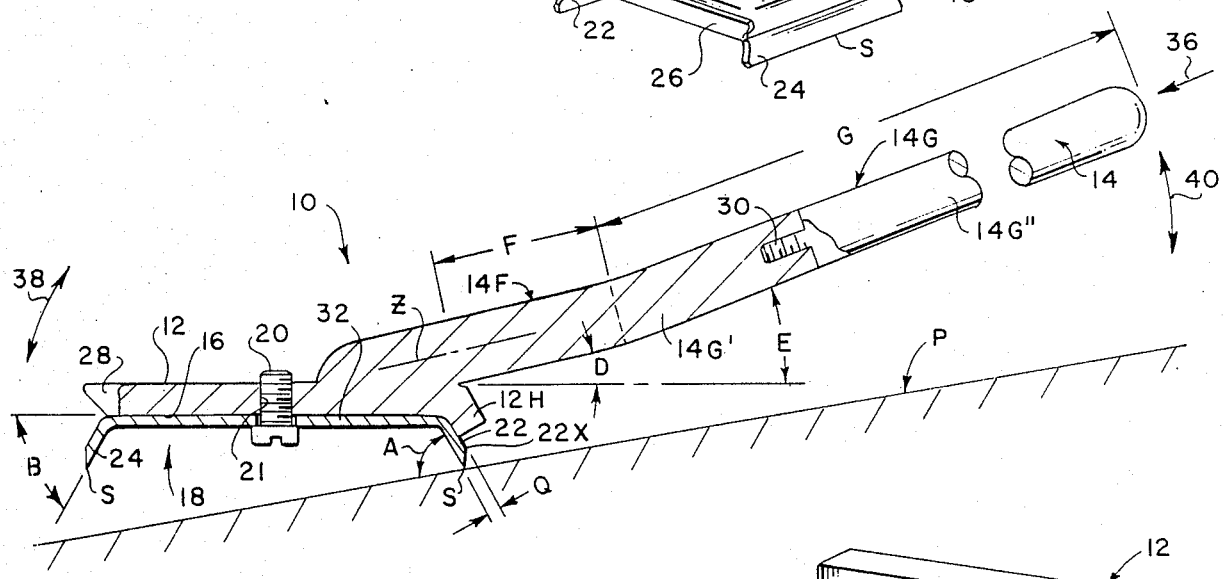
FIG. 2 is a side elevation view, partially in section, of the scraper tool shown in FIG. 1.
Figure 3:
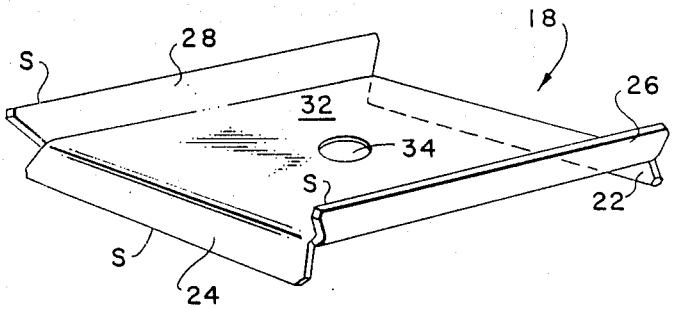
FIG. 3 is a perspective view of the scraper plate shown in FIGS. 1 and 2.
Figure 4:
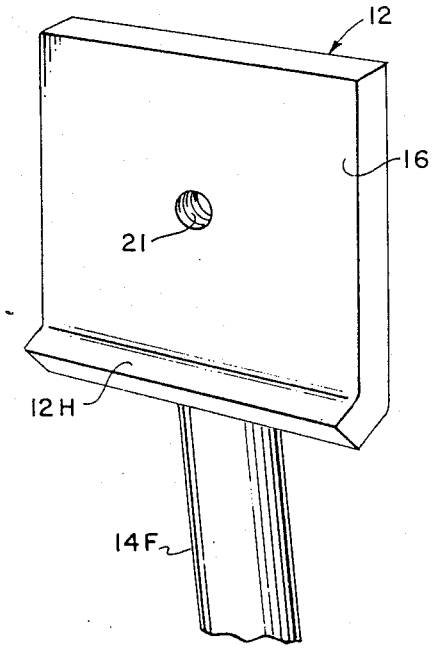
FIG. 4 is a perspective view of the support head shown in FIGS. 1 and 2.

Referring now to FIG. 1, FIG. 2 and FIG. 3, the scraper tool 10 of the present invention includes a substantially square support head 12 attached to an elongated handle 14. The support head 12 has a planar coupling surface 16 formed on its underside. A scraper plate 18 is attached to the coupling surface 16 by a screw fastener 20. A threaded bore 21 is formed through the support head 12 for receiving the fastener 20. The scraper plate 18 has downwardly depending blades 22, 24 at opposite ends thereof and reversible, upwardly projecting side blades 26 and 28. The scraper blade 24 is oriented for pull scraping action and scraper blade 22 is oriented for push scraping action.

The support head 12 includes a downwardly depending, transverse heel 12H against which the push blade 22 is adapted to nest when mounted on support base 12. The push blade 22 has a deflectable portion 22X which projects outwardly from the lower edge of the heel 12H.

The handle 14 is formed in two sections 14F, 14G which are inclined with respect to each other by an angle of approximately 163°. The handle 14 has a connecting section 14F having a length F of about 2½ inches and is inclined at an angle D of about 7 degrees. The connecting section 14F is integrally formed with the gripping section 14G having a length G of about 15½ inches and is inclined at an angle E of about 24 degrees. The slope angles D and E are measured between the handle sections 14F, 14G and the planar coupling surface 16, respectively, as indicated in FIG. 2

Preferably, the handle section 14G is formed in two segments 14G' and 14G" with the first segment 14G' being about 5½ inches in length, and the segment 14G" being about 10 inches in length. The segments 14G' and 14G" are joined together by a threaded stud 30. According to this arrangement, the second handle segment 14G" can be removed to provide a shorter handle for use in tight areas, for example, for scraping finished surfaces on door frames, windows and the like.

The scraper plate 18 and blades 22, 24 are formed from substantially square metal stock of thickness Q preferably of about 0.033 inch to 0.036 inch and of temper hardness in the range of Rockwell 60 -65. The support head 12 and the handle sections 14F, 14G' are preferably integrally formed of a durable metal such as aluminum. The handle section 14G" is also preferably formed of aluminum.

The blades 22 and 24 extend transversely oriented in one direction and blades 26 and 28 extend transversely oriented in the opposite direction. The transverse projection 22X of the push blade relative to the lower edge of the heel 12H is preferably ¼ inch. Each of the blades 22, 24 is inclined at an angle B of approximately 68–75 degrees with respect to the coupling surface 32 of the scraper plate 18. The taper of each scraper edge S is preferably 60 degrees from the outside radius to the inside radius thereof.

The scraper plate 18 is mounted onto the coupling surface 16 of the support head 12 by the screw fastener 20 which extends through a bore 34 and secures the plate 18 and the downwardly depending blades 22, 24 into appropriate scraping orientation relative to the handle 14. At the same time, the upwardly extending blades 26, 28 embrace opposite sides of the support head 12 and are retained in standby thereon as a replacement should one of the lower blades become dulled or broken.

Referring now to FIG. 2, the handle 14 is pushed as indicated by the arrow 36 with the blade 22 dragging in scraping contact with a painted surface P. During a forward push in the direction 36 in which the majority of scraping is conducted and during which the major reaction forces are encountered, the push blade 22 receives reinforced backup support from the transverse heel 12H. The handle section 14G is sloped upwardly relative to the coupling surface 16 of the support head 12 by a total angle E of approximately 24 degrees. Because the handle 14 is formed in two sections which are angularly inclined with respect to each other, a pushing force applied along the direction as indicated by the arrow 36 operates through a pressure point behind the push blade 22 and along a line which is transverse to the painted surface P.

According to this arrangement, both the support head 12 and handle 14 are free to pivot about the line of engagement of the push blade cutting edge S as the cutting edge glides across the finished surface P. The angle B of the push blade 22 and the inclination angle D of the connecting handle section 14F are selected to yield a desired angle of attack A when the axis Z of the connecting handle section 14F is held in parallel with the painted surface P (FIG. 2). In that orientation, the slope of the gripping handle section G also provides clearance for the operator's hand to hold onto the handle without rubbing against the painted surface P. The pull blade 24 is held away from the surface P during the push scraping operation.

Because the scraper head 12 and handle 14 pivot about the push blade 22 as indicated by the arrows 38, 40, efficient scraping action in the push scraping mode of operation can be obtained by manually adjusting the angle of attack A and increasing or decreasing the transverse hand pressure applied against the support head 12 while simultaneously observing the smoothness of the cleaning action. It has been observed that the best cleaning effect in the push scraping mode is achieved when the push blade 22 glides along in frictional engagement with the painted surface P without cutting into the underlying structure. The desired glide condition is indicated to the operator by the reaction forces which are transmitted through the push blade 22 into the support head 12 and handle 14. The reaction forces will be sensed as smooth and uniform when the angle of attack A and transverse hand pressure are correct.

Should the lower blades 22, 24 become damaged or otherwise dulled or broken, the screw fastener 20 is removed and the scraper plate 18 is disassembled. After removal, the blades 22, 24 may be sharpened or replaced. Alternatively, blades 26, 28 may be substituted for blades 22, 24 by inverting the plate 18 and rotating it by ninety degrees. In this manner, the upper and lower scraper blades are quickly interchanged to enable scraping to continue.

In the preferred embodiment, the longitudinal length of each scraper blade is about 3⅞ inches. A total handle length (F+G) of about 18 inches permits the scraper to be easil grasped by one or two hands as required for applying a scraping force in the course of pulling or pushing the scraper head over a work surface. Since replacement blades are initially provided in accordance with the scraper head construction hereof, down time for repair or replacement of the scraper 10 is minimized so as to avoid prolonged interruption of the job in which the scraper is utilized.

Although a particular embodiment of the invention has been illustrated and described, it is recognized that still other modifications and variations may occur to those skilled in the art, and that the basic concept of the invention may be practiced in other forms. Consequently, it is intended that the claims be interpreted to cover such modifications, variations and forms.

What is claimed is:

1. A hand held scraper tool comprising, in combination:

a support head having a scraper plate coupling surface and a heel projecting transversely to said coupling surface;

an elongated handle attached to said support head, said elongated handle being angularly inclined at a fixed, acute angle with respect to said coupling surface;

a scraper plate having a central portion removably attached to said support head coupling surface, said scraper plate having a scraper blade disposed for push scraping engagement against a workpiece; and, said heel being disposed in bracing engagement against said scraper blade for reacting against push forces imposed upon said scraper blade.

2. A scraper tool as defined in claim 1, said elongated handle having a gripping section inclined at a fixed angle of about 24 degrees relative to said coupling surface.

3. A scraper tool as defined in claim 1, said elongated handle having a connecting section attached to said support head, said handle connecting section being inclined at a fixed angle of about 7 degrees relative to said coupling surface.

4. A scraper tool as defined in claim 1, wherein said scraper blade is inclined with respect to said coupling surface at an acute angle in the range of about 65–75 degrees.

5. A scraper tool as defined in claim 1, said elongated handle having a gripping section and a connecting section, said connecting section being attached to said support head, and said gripping section being attached to said connecting section, said gripping section being angularly inclined with respect to said connecting section.

* * * * *